United States Patent [19]

Hardesty

[11] 4,241,974

[45] Dec. 30, 1980

[54] MULTI-OUTLET ADAPTER FOR MODULAR TELEPHONE CORDS

[75] Inventor: Edwin C. Hardesty, Perry Hall, Md.

[73] Assignee: Western Electric Company, Inc., New York, N.Y.

[21] Appl. No.: 35,174

[22] Filed: May 2, 1979

[51] Int. Cl.[3] ..... H01R 13/518

[52] U.S. Cl. ..... 339/154 A; 179/1 PC; 339/176 M

[58] Field of Search ..... 339/159 R, 154 A, 164 R, 339/164 M, 176 M, 91 R, 126 R; 179/1 PC

[56] References Cited

U.S. PATENT DOCUMENTS

| | | | |
|---|---|---|---|
| T958,009 | 5/1977 | Snyder | 339/99 R |
| 3,699,498 | 10/1972 | Hardesty et al. | 339/64 M |
| 3,718,892 | 2/1973 | Burgess et al. | 339/217 S X |
| 3,824,530 | 7/1974 | Roberts et al. | 339/99 R |
| 3,850,497 | 11/1974 | Krumreich et al. | 339/126 R |
| 3,990,764 | 11/1976 | Krumreich | 339/176 M |
| 4,025,141 | 5/1977 | Thelissen | 339/99 R |
| 4,047,787 | 9/1977 | Gumb | 339/154 A |
| 4,061,411 | 12/1977 | Gumb et al. | 339/159 R |
| 4,186,988 | 2/1980 | Kobler | 339/176 MP |

FOREIGN PATENT DOCUMENTS

| | | | |
|---|---|---|---|
| 1204159 | 1/1960 | France | 339/159 C |

*Primary Examiner*—Mark Rosenbaum
*Assistant Examiner*—Eugene F. Desmond
*Attorney, Agent, or Firm*—E. W. Somers

[57] ABSTRACT

An adapter (11) for connecting each of two telephone cords (12) to a wall terminal (14) includes a housing (16) having two stacked cavities (54–54') at one end, with each cavity being capable of receiving a modular plug (13) that terminates one of the cords and each communicating with a plug portion (17) that extends from an opposite end of the housing and that is insertable into the wall terminal. The adapter includes a plurality of wire-like contact elements (20) with each having a retroflexed portion for electrically engaging a contact (34) of the wall terminal when the plug portion is inserted thereinto, and each having free ends that extend into the cavities at the one end of the housing to engage blade-like terminals (21) of the modular plugs which are inserted into the cavities.

7 Claims, 11 Drawing Figures

MULTI-OUTLET ADAPTER FOR MODULAR TELEPHONE CORDS

TECHNICAL FIELD

This invention relates to a multi-outlet adapter for modular telephone cords, and, more particularly, relates to an adapter which may be inserted into a modular jack of a wall terminal and which has a pair of cavities for receiving modular plugs of modular plug-terminated telephone cords with facilities for connecting electrically the plugs to the jack.

BACKGROUND OF THE INVENTION

Modular plugs, which are used to terminate retractile cords that connect a telephone base to a handset, provide a customer as well as an installer with the capability of easily changing cords by removing the plugs from jacks in the base and handset and then reinstalling a new or refurbished cord. Newly obtained telephones are easily connected to existing wall terminals by inserting a modular plug which terminates one end of a line cord into a jack in the telephone base and the plug at the other end of the cord into a jack in the wall terminal.

Modular plugs for terminating telephone cords are shown, for example, in U.S. Pat. Nos. 3,699,498 and 3,761,869 which issued Oct. 17, 1972 and Sept. 25, 1973, respectively, both in the names of E. C. Hardesty, C. L. Krumreich, A. E. Mulbarger, Jr., and S. W. Walden. Jacks which are adapted to receive modular plugs that terminate new style flat telephone cords are shown for example in previously identified U.S. Pat. No. 3,699,498 and in U.S. Pat. Nos. 3,850,497 and 3,990,764, the latter two patents being issued on Nov. 26, 1974 and Nov. 9, 1976, respectively.

A jack which is provided in the wall terminal usually includes a single outlet for connecting a station instrument such as, for example, the telephone set to an associated telephone line. However, there are some situations in which it is desirable to be able to connect two station instruments such as, for example, a telephone answering device and an adjacent telephone set to the telephone line in parallel at the same location. There are other situations where it may be desirable to be able to connect an external signal source for an auxiliary power supply to telephone station equipment at the same location on the premises, such as, for example, to provide power to an incandescent lamp mounted within a telephone set for illuminating a dial or an array of pushbuttons. As should be evident, there is a need for an adapter to provide multiple access to a telephone line at a single wall terminal.

A prior art adapter which serves the aforementioned needs is shown for example, in D. R. Snyder defensive publication No. T958,009 published May 3, 1977. The adapter includes a jack portion and a plug portion, having a plurality of blade-like terminals that make electrical connections with conductors which are positioned within the adapter. Each conductor is doubled over within the plug portion, and both ends of each conductor are terminated with a wire spring contact. The contacts are exposed within a pair of externally communicating cavities of the jack portion to engage terminals of a modular plug which is inserted into each cavity to connect the terminals in the plug to contacts of a wall terminal jack. See also U.S. Pat. No. 4,061,411.

While the adapter disclosed and claimed in the aforementioned publication provides a means for connecting two modular plugs to a wall terminal, it includes a plurality of contacts and terminals as well as interconnecting conductors extending between the plug and jack portions. It would be most desirable to provide an adapter for interconnecting the plugs and the wall terminal while minimizing the number of components comprising the adapter in order to facilitate its manufacture.

SUMMARY OF THE INVENTION

The foregoing problems of the prior art are overcome by an adapter in accordance with this invention which includes a plug portion and a jack portion at opposite ends of the adapter, said ends being commonly referred to as a wall terminal end and a cord end. More particularly, the adapter includes a dielectric housing having a plurality of externally communicating cavities at the cord end thereof with each of the cavities adapted to receive a modular plug that is used to terminate a telephone cord and that includes a plurality of spaced, parallel terminals. The plug portion which is adapted to be received in a jack cavity of a wall terminal includes a plurality of spaced wire-receiving channels which communicate with and are aligned with spaced wire-receiving channels in each of the cavities at the cord end. A wire-like contact element is mounted in each of the channels of the plug portion and has a retroflexed configuration with one free end portion of each contact element extending into the aligned channel in one of the cavities and with the other free end portion of each of the contact elements extending into the associated aligned channel in the other one of the said cavities.

The adapter in accordance with this invention which includes a molded plastic housing and a plurality of contact elements mounted therein is constructed of a number of component parts which represents a substantial reduction from the number included in a prior art modular plug adapter. The contact elements which are made of wire spring-like metal such as Phosphor bronze have the free ends in stacked cavities at the cord end and are adapted to engage the exposed contact edges of blade-like terminals which are mounted in each of the plugs of a terminated telephone cord. A U-shaped portion of each of the contact elements which is received in the plug portion of the adapter is capable of being engaged by a wire-like spring contact in the jack of the wall terminal which receives the plug portion of the adapter.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
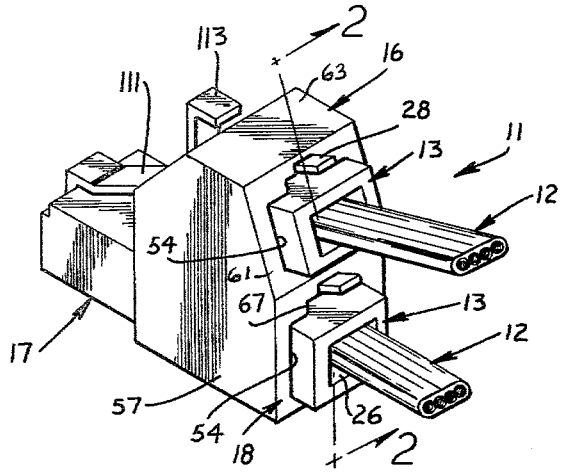
FIG. 1 is a perspective view of an multi-outlet adapter made in accordance with this invention for connecting modular plug-terminated telephone cords in parallel to a wall terminal.
Figure 2:
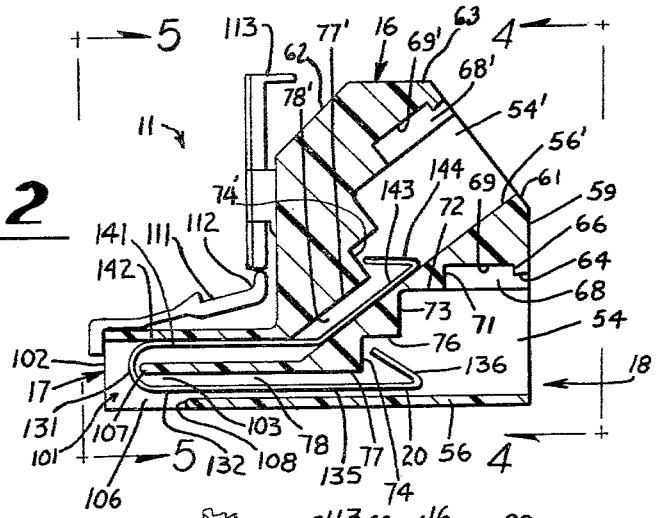
FIG. 2 is a side elevational view in cross-section of the adapter of FIG. 1 with modular plugs which terminate telephone cords removed therefrom.
Figure 3:
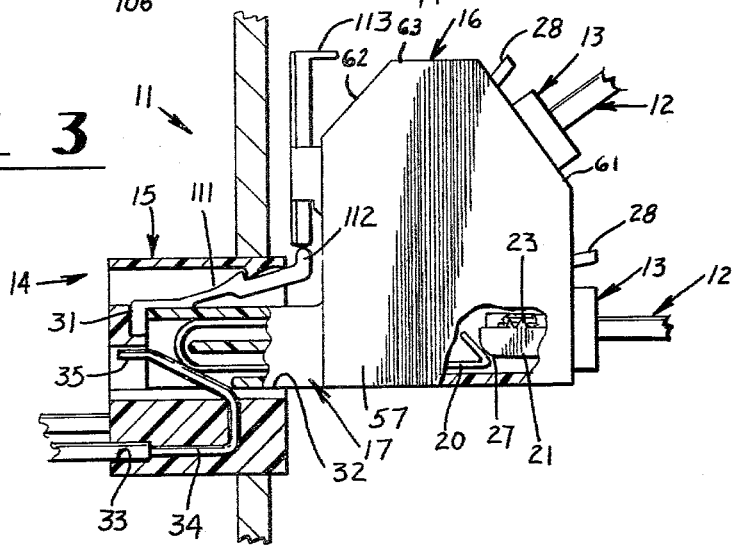
FIG. 3 is a side elevational view showing the use of the adapter to connect the telephone cords to a wall terminal.

Referring now to FIGS. 1, 2 and 3, an adapter, designated generally by the numeral 11, in accordance with this invention is used to interconnect two telephone cords 12—12, each of which is terminated with a modular plug 13, with a wall terminal 14 that includes a jack 15. The adapter 11 includes a housing, designated generally by the numeral 16, comprising a plug portion 17 that is insertable into the jack 15, a jack portion, designated generally by the numeral 18, which is capable of receiving two modular plugs 13—13 which terminate two cords 12—12, and a plurality of contact elements 20—20.

The modular plug 13 (see FIG. 1, for example), which may be that disclosed and claimed, for example, in U.S. Pat. No. 3,860,316 issued Jan. 2, 1975 in the name of E. C. Hardesty, includes a plurality of blade-like terminals 21—21 (see FIG. 3) which are mounted in a spaced, parallel array in a housing 22 made of a plastic material such as, for example, polycarbonate. Each of the terminals 21—21 includes a plurality of internally situated tangs 23—23 which engage electrically an insulated conductor 24 of the cord 12 that is inserted into a cavity 26 in the plug 13. Further, each of the terminals 21—21 includes an exposed edge surface 27 which is adapted to be engaged by an associated contact element 20 of the jack portion 18 into which the plug 13 is inserted. Each plug 13 includes a retaining clip 28 which is cammed downwardly as the plug is inserted into the jack portion 18 and which is depressed manually to remove it.

The jack 15 of the wall terminal 14, which may be one such as is disclosed for example, in priorly identified U.S. Pat. No. 3,850,497, comprises a dielectric support 31 having a plug-receiving cavity 32 that opens to the front of the support and a multiplicity of spaced orifices 33—33 that extend from the front to the rear of the support along one side of the cavity. An external component in the form of a wire-spring contact 34 is received in each orifice with free ends 35—35 of the contacts extending out of the front ends of the orifices and bent over so that they extend rearwardly in cantilever fashion within the plug-receiving cavity 32. The cantilevered free ends 35—35 of the wire spring contacts 34—34 provide the electrical connection with associated ones of the contact elements 20—20 of the mating adapter 11.

Turning now to FIG. 1, the adapter 11 which includes the housing 16 made from a material such as, for example, polycarbonate, may also have the jack portion 18 designated as a cord end and the plug portion 17 designated as a wall-terminal end. The wall-terminal end is similar in construction to a modular plug 13 and is adapted to be inserted into the jack 15 of a wall terminal 14 while the cord end is adapted to receive modular plugs 13—13 which terminate two flat or modular telephone cords 12—12.

As can best be seen in FIGS. 1 and 2, the housing 16 is made so that its cord end 18 includes two stacked, externally communicating cavities 54–54' each of which is designed to receive and conform to the configuration of the housing of a modular plug 13. The cord end 18 includes a floor 56, two side walls 57—57, an end wall 58 which is oriented toward the wall terminal and an end wall 59 which is oriented toward the cords. The cord end 18 also includes sloping top surfaces 61 and 62 which are joined together through a top surface 63.

Turning now to FIG. 2, it can be seen that a lowermost cavity 54 opens to an outer surface of the end wall 59 and includes an upper notch 64 which opens through an inner ledge 66 and outer steps 67—67 to an enlarged pocket 68 having a roof 69 and a rear wall 71. The inner end of the rear wall 71 of the pocket 68 joins to a ceiling 72 of the main cavity 54 which has a stepped rear wall comprising vertical portions 73 and 74 joined through a horizontal portion 76. A lowermost portion of the vertical surface 74 terminates at its intersection with a surface 77 which extends toward the wall terminal end of the adapter 11 and which together with the floor 56 of the cord end define a passageway 78 for receiving electrical connecting facilities such as the contact elements 20—20.

The upper stacked cavity 54' is configured similar to the cavity 54 and its elements which correspond to those of the cavity 54 have been designated with the same numerals having a prime superscript. A floor 56' of the upper cavity 54' and its horizontal extension 81 thereof together with a surface 77' and an extension thereof define a passageway 78' which is adapted to receive electrical connecting facilities to be described hereafter.

When a plug 13 of a modular cord 12 has been inserted into one of the cavities 54–54', the retaining clip 28 of the plug returns upwardly to a generally non-depressed position so that it snap-locks into the pocket 68 or 68' of the cavity and retains the plug within the adapter 11 during use. As with any modular jack and plug arrangement, the removal of the plug 13 requires only the manual depression of the retaining clip 28 followed by withdrawal of the plug from the cavity into which it had been inserted.

Figure 4:
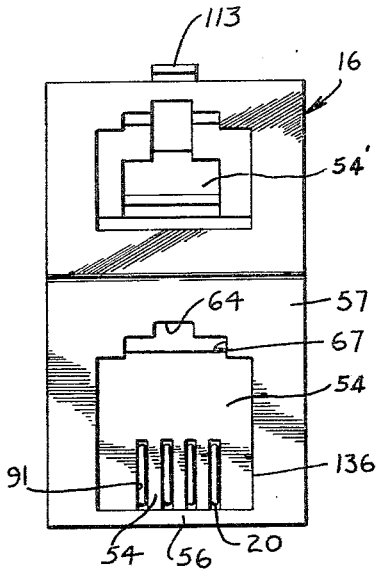
FIG. 4 is an end view from the telephone cord end of the adapter.

Referring to FIG. 4 of the drawing, each portion of the cord end 18 in accordance with the present invention comprises a plurality of contact-receiving channels 91—91 and 91–91'. Each of the channels 91 and 91' extends between the associated floor 56 and 56' to the associated ledge 76 or 76' which effectively provides a compartment for an electrical contact element 20. It is within the scope of this invention to provide channels 91 and 91' in the form of bores such as those provided in a standard modular jack to receive the electrical connecting elements therein.

Figure 5:
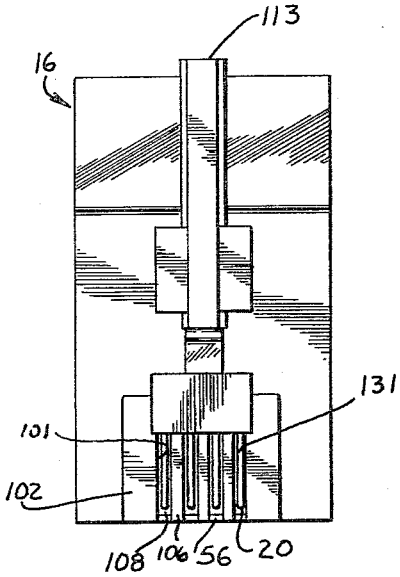
FIG. 5 is an end view of the wall terminal end of the adapter of FIG. 1.

Going now to both FIGS. 2 and 5, the wall terminal end 17 includes a plurality, such as four, for example, of parallel contact receiving channels 101—101, each of which includes a lower portion 103 which extends from an end wall 102 of the passageway 78 that communicates with the cavity 54 of the cord end 18. The channels 101—101 are separated from one another by a plurality of spaced fins 106—106 which are spaced apart on centers that correspond to the center-to-center spacing of the terminals 21—21 in a conventional modular plug 13. The spacing between the channels 101—101 is the same as the spacing between the channels 91—91 in the cavity 54 and the same as that in the cavity 54' with each channel in the plug portion 16 being associated, aligned with, and in communication with a channel 91 in the cavity 54 and a channel 91' in the cavity 54'. As is seen in FIG. 2, the portion of the channel 101 which communicates with a channel 91 in the cavity 54 is separated vertically from the portion which communicates with the channel 91' in the cavity 54' by a partition 107 that extends between the adjacent fins 106—106. The partitions 107—107 are formed so that their free ends are spaced a predetermined distance from the end wall 102 of the plug portion 17. Also, the floor 56 of the housing 16 is spaced from the surface 102 of the plug portion 17 to provide windows 108—108.

A description of the housing 16 is completed by the description of a resilient retaining or latch clip 111 which is adjacent a top of the housing and which extends toward the wall 58 where it has an upwardly disposed portion 112. The latch clip 111 is depressed by a slidably mounted plunger 113 which engages the upwardly disposed portion 112. As an adapter 11 is inserted into a wall terminal 14, the latch clip 111 is depressed by its engagement with a surface of the jack. Then, when it is desired to withdraw the adapter 11, a user pushes downwardly on the plunger 113 to depress the latch clip 111 and moves slidably the adapter from the jack 15.

The adapter 11 further includes a plurality of contact elements 20—20 in the form of a wire formed from a high tensile strength spring material such as, for example, spring temper Phosphor bronze.

Figure 6A:
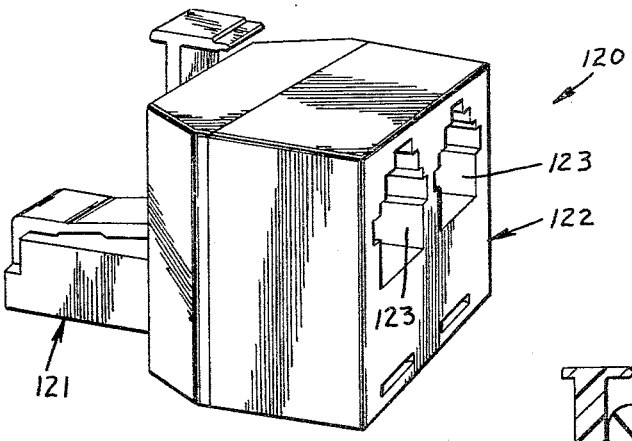
FIGS. 6A and 6B are perspective and side elevational views, respectively, of a prior art adapter.
Figure 6B:
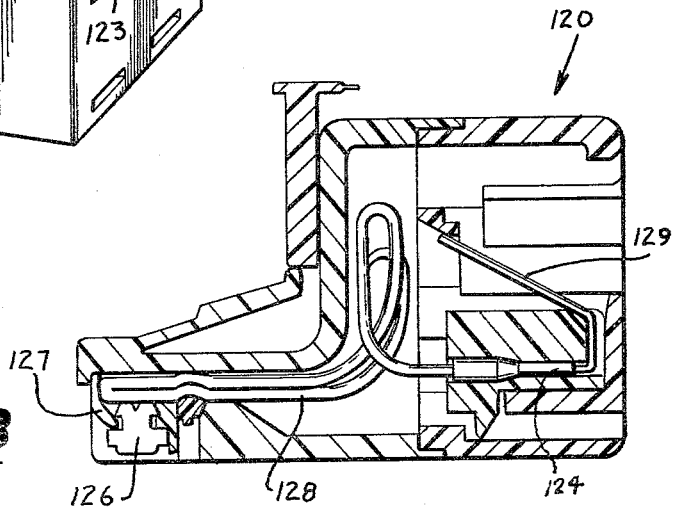

In the previously mentioned D. R. Snyder publication, an adapter 120 shown in FIGS. 6A and 6B includes a plug end 121 and a cord end 122. The cord end 122 includes two side-by-side jack cavities 123—123 such that all the wire spring contacts 124—124 which are exposed within the cavities are disposed in a linear array. Also, and as can best be seen in FIG. 6B, the plug portion includes a plurality of terminals 126—126 having tangs 127—127 which make electrical contact with conductors 128—128 that are doubled over within channels within the plug portion. One end of each conductor is connected to a wire spring contact 129 which extends into one of the jack cavities while the other end of each conductor is connected to a contact 129' that extends into the other jack cavity.

In contrast to the above-identified prior art adapter, the adapter 11 of this invention avoids the necessity of having to route insulated conductors within the housing 16. Each contact element 20 of this invention is formed to provide a first portion 131, which is retroflexed and which is positioned within one of the wire-receiving channels 101—101 of the plug portion 17, the channel being slightly larger in cross-section than the contact. The contact elements 20—20 are positioned within the channels 101—101 so that a portion 132 of each is exposed to the outer surface of the floor 56 through the windows 108—108 so that they can be engaged by associated ones of the wire contacts 34—34 in the jack cavity into which the plug portion is inserted.

In addition, each wire spring contact element 20 is formed to provide a second portion 135 that extends through the passageway 78 into an aligned channel 91. The second portion 135 has its free end 136 formed into a hook-like configuration designed to be engaged by an associated terminal 21 of a plug 13 which is inserted into the cavity 54.

Finally, each contact element 20 includes a third portion 141 having a portion 142 that is parallel to the portion 135 and a portion 143 that extends into an aligned associated channel 91'. The portion 143 like free end portion 144 that is exposed within the cavity 54' to be engaged by a terminal 21 of a plug 13 inserted into the upper cavity. With the adapter 11, the terminals 21—21 of the plugs 13—13 are connected in parallel through the end portions 135 and 144 to the portion of the contact elements 20—20 which are exposed in the windows 108—108 and hence to the aligned contacts 34—34 of the jack 15.

In one method of making the adapter 11, the housing 16 may be constructed in two parts, the jack portion 18 and the plug portion 17. The contact elements 20—20 are inserted into the jack portion 18 where the passageways thereof open to the surface 58. Then the plug portion 17 is bonded, for example, untrasonically to the jack portion 18. Alternatively, the housing 16 may be molded unipartitely and the contacts 20—20 inserted from the plug portion 17 with the portions 136 and 144 depressed and adjacent the portions 135 and 143 until the portions 136 and 144 reach the cavities 54 and 54' where they spring return to the position shown in FIG. 2 under the ledges 76–76'. The predetermined distance at which the retroflexed portions 131—131 of the contact elements 20—20 are spaced from the wall 102 is such that when the retroflexed portions engage the horizontal partition 107 as a result of insertion, the free end portions, which are depressed during their movement through the passageways 78 and 78', clear the surfaces 74 and 74' so that they can spring-return to a confined position under the ledges 76–76'.

In at least one application of an adapter 200 in accordance with this invention, a telephone instrument which requires low voltage power for illumination, for example, is connected through a terminated cord into one of the jack cavities 54–54' and the low voltage source is connected into the other cavity. The adapter 200 will be described with elements thereof which correspond to elements in the adapter 11 having the same numerical designation increased by two hundred. The adapter 200 (see FIGS. 7–10) in accordance with an alternative embodiment of this invention includes facilities not only for electrical connections which extend between one of two jack cavities 254–254' through a jack portion 218 to the other jack cavity, but also electrical interconnections which extend between the jack cavities, but which are not capable of being contacted electrically through the plug end 218 to the wall terminal 14.

Figure 7:
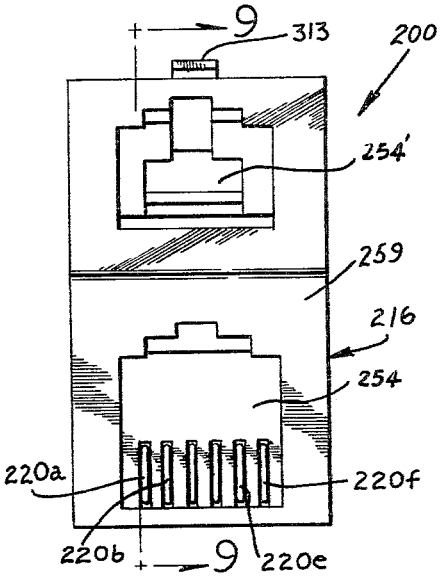
FIG. 7 is an end view of an alternative embodiment of the adapter as taken from the telephone cord end thereof.
Figure 8:
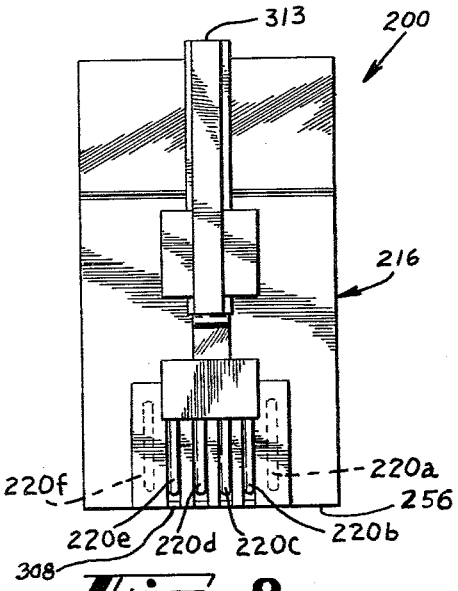
FIG. 8 is an end view of the wall terminal end of the alternative embodiment of the adapter.
Figure 9:
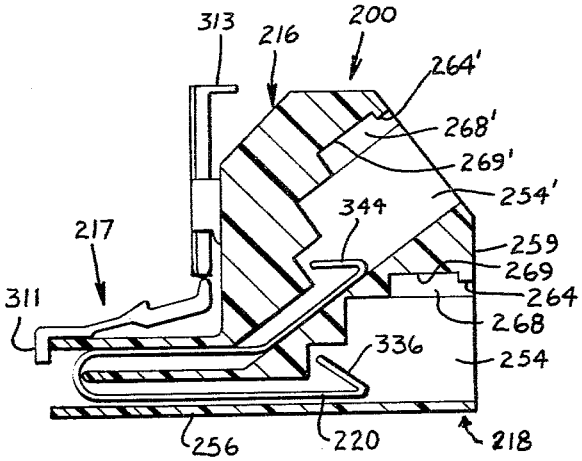
FIG. 9 is a side elevational view in section of the alternative embodiment of the adapter shown in FIG. 7 and taken along lines 9—9 thereof.
Figure 10:
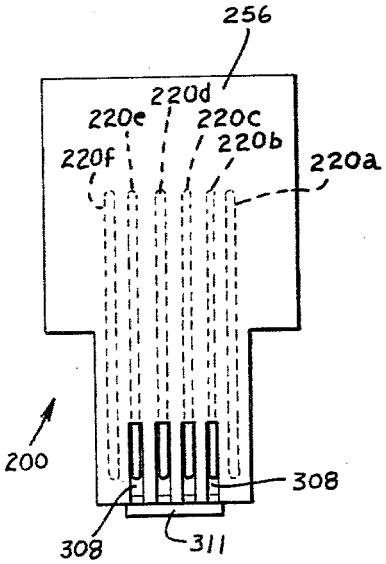
FIG. 10 is a plan view of the alternative embodiment of the adapter shown in FIG. 7 and taken from the underside thereof.

Referring now to FIGS. 7 and 9, the adapter 200 includes a housing 216 which includes a plug portion 217 and a jack portion 218 having two jack cavities 254–254' for receiving plugs 13—13. The adapter 200 includes six contact elements **220*a*–220*f* which extend from one of the cavities 254 to the plug 217 and then to the other cavity 254'. Each of the outermost contact elements 220*a* and 220*f* in this array are to be used to connect electrically between the cavities 254–254' while the four contact elements, 220*b*–220*e*, therebetween are to be used to connect a plug 13 in each of the cavities to the wall terminal 14**.

The adapter 200 must be constructed so that the contact elements **220*a* and 220*f* are not capable of being contacted electrically by external components such as, for example, the wire contacts 35—35 in the wall terminal 14 when the plug portion 217 is inserted into the jack 15. As can best be seen in FIGS. 8 and 10, the housing 216 is constructed so that a floor 256 includes a plurality of windows 308—308 so that a portion of each of the contact elements 220*b*–220*e* are exposed and capable of being engaged by associated ones of the wire spring contacts 34—34. On the other hand, there are no windows in the floor 256 below and aligned with each of the contact elements 220*a* and 220*f* so that they are not exposed at the plug end and hence so that they are not capable of being contacted by contacts 34—34 within the jack 15 of the wall terminal 14**.

It is to be understood that the above-described arrangements are simply illustrative of the invention. Other arrangements may be devised by those skilled in the art which will embody the principles of the invention and fall within the spirit and scope thereof.

What is claimed is:

1. An adapter for connecting electrically terminals in each of a plurality of modular plugs to external components in a jack, said adapter comprising:

a dielectric housing having a jack portion at one end and a plug portion at an opposite end, said jack portion including a plurality of superimposed, externally communicating cavities each of which is adapted to receive a modular plug that includes a plurality of spaced parallel terminals, each of said cavities including a plurality of wire-receiving channels with each channel in one of the cavities being associated and aligned with a channel in the other cavity, said plug portion adapted to be received in a jack and including a plurality of spaced wire-receiving channels each of which has an externally communicating portion and each of which is associated with and communicates with aligned wire-receiving channels in said cavities, said housing including a plurality of dielectrically isolated, superimposed passageways which communicate said channels of said plug with associated ones of said wire-receiving channels in each said cavity of said jack portion; and a wire-like, substantially uniplanar contact element mounted in each of said channels of said plug portion with a portion thereof being exposed in said externally communicating portion of each said channel in said plug portion to facilitate engagement with an external component in said jack when said plug portion is received in the jack, and having a retroflexed configuration with one free end portion of each contact element extending along an associated passageway of said housing into the associated channel in one of said cavities in said jack portion and the other free end extending along an aligned superimposed passageway into the associated, aligned channel in the other one of said superimposed cavities, said free end portions being exposed within said cavities and adapted to be engaged by said plug terminals when said plugs are received in said cavities, said portions of said contact element which extend along said passageways being separated and dielectrically isolated from each other.

2. A multi-outlet adapter for plug-in telephones, comprising:

a housing made of a dielectric material and having one end which is adapted to be received in a cavity of a jack and having an opposite end which is adapted to receive a pair of modular plugs each of which terminates a telephone cord, said housing including a first plurality of spaced passageways that extend from said one end to said opposite end and a second plurality of spaced passageways that extend from said one end to said opposite end, said first and second pluralities being superimposed, said housing further comprising:

a plug portion at said one end, said plug portion having a plurality of channels each of said channels being associated with and communicating with one of said passageways, each of said channels having two spaced portions with one of said portions of each channel opening to an external surface of said housing at said one end and communicating with one of said first plurality of spaced passageways and with the other portion of each said channel in said plug portion communicating with one of said second plurality of spaced passageways; and a jack portion at said other end of said housing and having a superimposed pair of externally communicating openings each of which is capable of receiving a modular plug, each of said openings having a plurality of channels with said channels in one of said openings in said jack portion being associated and aligned with said first plurality of passageways in said housing and with said channels in the other one of said openings in said jack portion being associated and aligned with said second plurality of passageways and a wire-like contact element positioned within each channel in the plug portion with one portion of each contact element being positioned within said one of said portions of its associated channel to facilitate engagement of the wire-like contact element by an external component in said jack cavity and having a free end thereof extending through an associated passageway of said first plurality of passageways into the aligned channel in one of said openings in said jack portion, and another portion of each contact element positioned within the other one of said portions of its associated channel in said plug portion and having its free end extending through an associated passageway of said second plurality of passageways and into the aligned channel in the other one of said openings in said jack portion, said free ends capable of being engaged electrically by terminals in the modular plugs which are received in said openings.

3. The adapter of claim 2, wherein each of said one portions of said channels in said plug portion open to said external surface through a window, said adapter having at least one channel in said plug portion constructed without a window to cover the contact element in said at least one channel in said plug portion to preclude its engagement by external components in said jack cavity when said plug portion is inserted thereinto.

4. The adapter of claim 2, wherein said first and second portions of each said channel in said plug portion are separated by a partition which extends towards but is spaced from an end wall of the plug portion.

5. The adapter of claim 4, wherein each said contact element is generally U-shaped, extending from the first portion of the channel, between said partition and said end wall of the plug portion, and into the second portion of the channel, each said contact element having one leg that extends along said associated passageway of said first plurality into one of said openings in said jack portion and its other leg extending parallel to the one leg along said associated passageway of said second plurality and then inclined thereto and into the other opening of the jack portion.

6. The adapter of claim 5, wherein a portion of each contact element in said first portion of its channel is exposed to an outer surface of a wall that partially defines a passageway which communicates the first portion of each channel in the plug portion with the associated aligned channel in the one opening of the jack portion.

7. The adapter of claim 4, wherein each of said contact elements has a retroflexed portion disposed in the plug portion of the housing which is adapted to be engaged by said external component, said ends thereof which extend into the aligned channels of said jack portion having hook-like ends, said housing which defines said openings being formed to include a stepped portion at an inner end of each of said openings with the hook-like end of each contact element being in at least proximate engagement with said stepped portion to lock said contact element within said housing, and wherein the end of said partition which extends toward said end wall of said plug portion is spaced therefrom so that when each of said contact elements is positioned within said housing with its retroflexed portion in proximate engagement with said end of said partition, said hook-like portions are in at least proximate engagement with the stepped portions to lock said contact element within said housing.

* * * * *